US005511667A

United States Patent [19]

Carder

[11] Patent Number: 5,511,667

[45] Date of Patent: Apr. 30, 1996

[54] HONEYCOMB CORNER PROTECTOR

[75] Inventor: Reuben C. Carder, Michigan City, Ind.

[73] Assignee: Hexacomb Corporation, Lincolnshire, Ill.

[21] Appl. No.: 229,375

[22] Filed: Apr. 18, 1994

[51] Int. Cl.[6] ..... B65D 81/133

[52] U.S. Cl. ..... 206/586; 206/521

[58] Field of Search ..... 206/453, 521, 206/586–591, 594; 248/345.1

[56] References Cited

U.S. PATENT DOCUMENTS

| | | | |
|---|---|---|---|
| 2,006,224 | 6/1935 | Weber et al. | 206/586 |
| 2,574,181 | 11/1951 | Hess | 216/23 |
| 2,933,122 | 4/1960 | Christman | 153/2 |
| 3,220,683 | 11/1965 | Doll | 206/586 |
| 3,255,949 | 6/1966 | Buttery | 229/51 |
| 3,314,339 | 4/1967 | Guffy et al. | 93/58.1 |
| 3,349,984 | 10/1967 | Halko, Jr. | 206/586 |
| 3,481,813 | 12/1969 | Wiggers | 156/211 |
| 3,655,112 | 4/1972 | Jeffers | 229/14 C |
| 3,746,593 | 7/1973 | Majewski et al. | 156/207 |
| 3,785,908 | 1/1974 | Wagers et al. | 156/479 |
| 3,843,038 | 10/1974 | Sax | 206/586 |
| 3,890,108 | 6/1975 | Welsh | 29/191.4 |
| 3,900,156 | 8/1975 | Clark, Jr. | 229/14 C |
| 3,994,433 | 11/1976 | Jenkins et al. | 206/586 |
| 4,194,313 | 3/1980 | Downing | 40/610 |
| 4,596,541 | 6/1986 | Ward, Sr. et al. | 493/59 |
| 4,883,179 | 11/1989 | Dionne | 206/523 |
| 5,040,696 | 8/1991 | Liebel | 220/441 |
| 5,175,041 | 12/1992 | Webb et al. | 428/116 |

FOREIGN PATENT DOCUMENTS

| | | | |
|---|---|---|---|
| 2081678 | 2/1982 | United Kingdom | 206/586 |

OTHER PUBLICATIONS

1991 International Honeycomb Corporation Brochure entitled *"Inner Packaging"*.

Two (2) photographs showing one embodiment of a slit scored honeycomb corner protector made and sold by Hexacomb Corporation–No Date.

Two (2) photographs showing another embodiment of a slit scored honeycomb corner protector made and sold by Hexacomb Corporation–No Date.

*Primary Examiner*—Jimmy G. Foster

*Attorney, Agent, or Firm*—Olson & Hierl, Ltd.

[57] ABSTRACT

A honeycomb protector for protecting the corners or edges of articles during shipping of such articles comprising a flat panel including first, second, third and fourth portions which are foldable to form the protector. In one embodiment, the fourth portion includes a finger which fits within a notch in the third portion for connecting the third and fourth portions together co-planarly when the protector is folded. The portions are preferably foldably connected to each other by crush slit scores. The crush slit score foldably connecting selected portions has a bevel angle in a preselected range providing a spring-biasing action between the selected portions when the panel is folded. The spring biasing action causes the finger to lock in the notch to assure that the protector does not unfold while the article is being packaged for shipment.

42 Claims, 3 Drawing Sheets

HONEYCOMB CORNER PROTECTOR

TECHNICAL FIELD

This invention relates generally to a protector for the corner or edge of an article to be packaged and, more particularly, to an improved honeycomb corner protector.

BACKGROUND OF THE INVENTION

For many years, protectors have been secured to the corners of manufactured articles such as appliances, electronic articles and doors, prior to such articles being packaged to protect the corners and other surfaces of such articles from damage during handling and shipment. A type of corner protector currently in use is made of corrugated paper-board or paper honeycomb material and is supplied to the manufacturer of the articles to be packaged in flat form. The corner protector is thereafter folded by the manufacturer, then taped, glued or stapled so that it remains folded, and then it is applied to the corners of the article to be shipped.

A problem associated with the use of this type of corner protector is that it requires as extra manufacturing step, i.e., taping, gluing, or stapling during the folding operation, and that it has a tendency to unfold and fall off the article prior to the article being packaged, thus complicating and unnecessarily decreasing the efficiency of the packing operation. Thus, there remains a need for a corner protector which does not require taping, gluing, or stapling during the folding operation and which will not unfold and fall off the corner of the article prior to or during packaging of the article.

In addition, corrugated cardboard which was previously used requires several layers to provide the needed thickness for protecting the article. This made such protectors difficult and relatively costly to use. Accordingly, what is needed is a protector thick enough and having a cushioning effect to protect the object. The protector should be easy to assemble without the need of other materials. The present invention meets these desires.

SUMMARY OF THE INVENTION

The present invention is a protector for the corner of an object. The protector comprises a honeycomb panel including foldable first, second, third and fourth portions. The first portion is operably associated with the second portion such as by being foldably connected along a fold-line. The third portion is foldably connected along another fold-line to the first portion, and the fourth portion is foldably connected along still another fold-line to the second portion. The fold-lines preferably comprise crush slit scores. The crush slit scores are particularly advantageous as they allow the use of honeycomb panels which are thicker and provide better protection than prior corrugated cardboard devices.

In the one embodiment of the invention, the third portion includes a notch and first and second sides. The first side of the third portion is connected to the fold-line foldably connecting the first and third portions and the second side is parallel to the fold-line foldably connecting the first and second portions and offset therefrom. The notch is cut out of the second side. The fourth portion includes a finger and first and second parallel sides. The first side of the third portion is connected to the fold-line foldably connecting the second and fourth portions and the finger extends from the second side of the third portion. When the panel is folded, the first, second and third portions and the fold-lines are generally perpendicular to each other, the third and fourth portions are co-planar, the finger fits into the notch and the second sides of the third and fourth portions abut each other thereby connecting the third and fourth portions.

In another embodiment of the invention, each of the third and fourth portions includes a finger and a notch adjacent to and generally parallel to the finger. When the panel is folded, the first, second and third portions and the fold-lines are generally perpendicular to each other, the third and fourth portions are co-planar and the finger on the third portion fits into the notch in the fourth portion and the finger on the fourth portion fits into the notch in the third portion.

In still another embodiment, the panel includes a fifth portion including first and second sides and each of the first and second portions includes first and second sides. The first side of the first portion is foldably connected to the first side of the fifth portion along a fold-line and the first side of the second portion is foldably connected to the second side of the fifth portion along a fold-line. The third portion is foldably connected to the second side of the first portion along a fold-line and the fourth portion is foldably connected to the second side of the second portion along a fold-line.

To connect the third and fourth portions in the folded position, a locking means is provided. The third portion includes a notch disposed between first and second fingers and the fourth portion includes a finger disposed between first and second notches, the first and second fingers fitting within the first and second notches respectively and the finger fitting within the notch to connect the third and fourth portions together when the panel is folded.

In one preferred embodiment, at least one of the crush slit scores connecting the portions has a bevel angle in a range providing a spring biasing action when the panel is folded. The spring biasing action causes the locking of the finger on the third portion in the notch in the fourth portion. Because the present invention is made from a honeycomb panel, it provides not only the thickness required to protect the object, but also a cushioning effect, due to the presence of the honeycomb core, which is not available with corrugated cardboard. The combination of the crush slit scores and the locking means allows a panel of the thickness of a honeycomb panel to be used. In addition, the combination provides the proper spring biasing to keep the corner protector in its folded position. This combination of elements and the resulting advantages are nowhere suggested in the prior art.

BRIEF DESCRIPTION OF THE DRAWINGS

In the accompanying drawings which form a portion of this disclosure.

DESCRIPTION OF THE PREFERRED EMBODIMENTS

Figure 1:
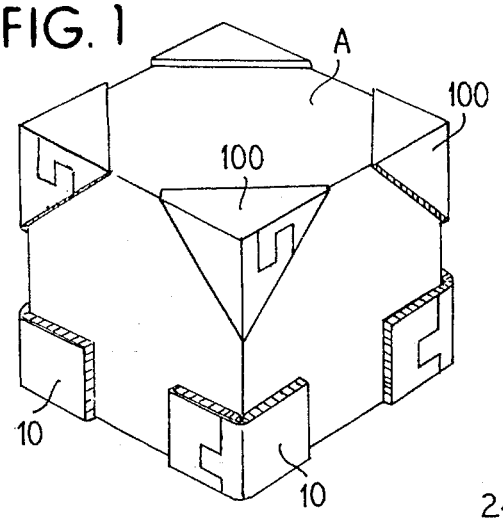
FIG. 1 is a perspective view of a box-like article with alternate embodiments of protectors constructed in accordance with the present invention positioned over the corners thereof.

Referring to FIG. 1, an article A is shown having protectors 10 and 100, constructed in accordance with the present invention, positioned over its corners for protecting the corners and surfaces of the article A from damage during handling and shipping. The article A may be a manufactured good such as an appliance or electronic article such as a television.

Figure 2:
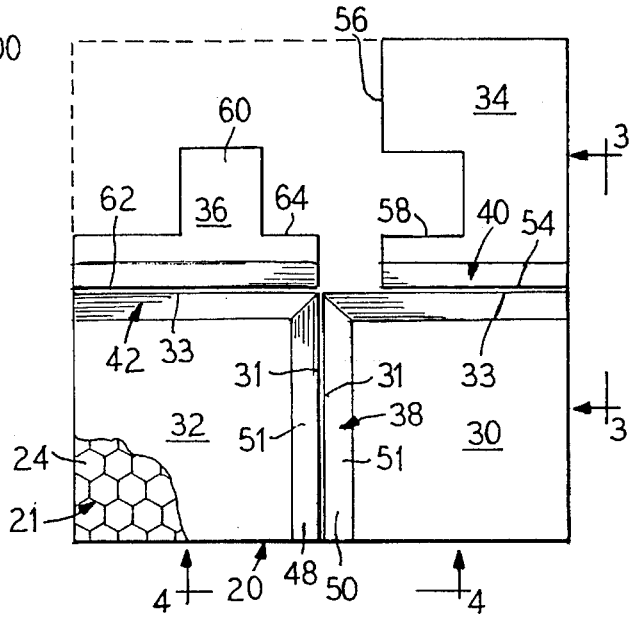
FIG. 2 is a plan view of a blank for forming a first embodiment of a corner protector.
Figure 3:
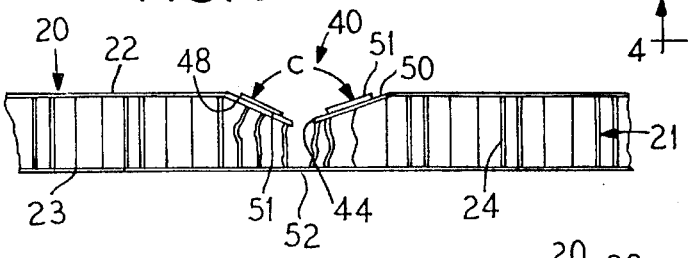
FIG. 3 is an enlarged, fragmentary end view taken along the lines 3–3 of FIG. 2.
Figure 4:
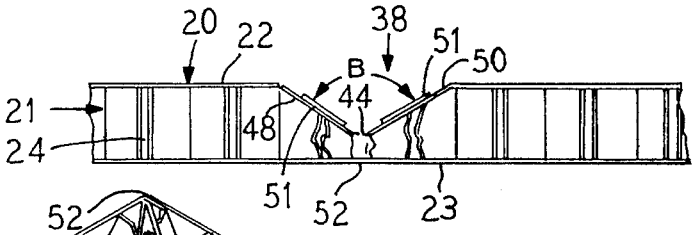
FIG. 4 is an enlarged, fragmentary end view taken along the lines 4–4 of FIG. 2.

FIG. 2 shows protector 10 in its flat, unfolded or blank form. Referring to FIGS. 2–4, the protector 10 comprises a panel 20 including a honeycomb core 21 sandwiched between a first face sheet 22 and a second face sheet 23. The core 21 is comprised of a plurality of honeycomb cells 24 which are disposed generally perpendicular to the face sheets 22 and 23. Preferably, the honeycomb core 21 and the face sheets 22 and 23 are made of a kraft paper. The panel 20 is made from a honeycomb square blank whose outline is shown in phantom in FIG. 2. Preferably, the blank measures about 9 by 9 inches (23 by 23 cm.) or about 10 by 10 inches (25 by 25 cm.). A 9 by 9 inches blank preferably has a thickness of between about ½ to ¾ inches (13 to 19 mm ) while a 10 by 10 inches blank preferably has a thickness between about ½ to 1 inches (13 to 25 mm.). Although the above dimensions are preferable for most applications, they are not limiting. Typically, the thickness of the panel is increased as the size of the panel is increased.

Referring back to FIG. 2, the panel 20 includes a first square portion 30, a second square portion 32, a third generally rectangular portion 34 and a fourth portion 36. Each of the first and second portions 30 and 32 includes two converging or adjacent sides 31 and 33. The second portion 32 is connected to the first portion 30 by a central crush slit score 38. The third portion 34 is connected to the first portion 30 by a central crush slit score 40. The fourth portion 36 is connected to the second portion 32 by a central crush slit score 42.

Referring to FIGS. 3 and 4, each of the crush slit scores 38, 40 and 42 is comprised of a longitudinally extending central slit 44 which is cut through the first face sheet 22 and opposed inclined surfaces 48 and 50. Adhesive means 51 such as double-sided tape or an application of an adhesive such as glue may be placed on the surfaces 48 and 50 to assist in holding the portions together when the panel 20 is folded. The intact second face sheet 23 acts as a hinge or fold-line 52 about which the portions 30, 32, 34, and 36 rotate when the panel 20 is folded. The crush slit scores 38 and 40 form the two converging or adjacent sides 31 and 33 respectively of first portion 30 while the crush slit scores 38 and 42 form the two converging or adjacent sides 31 and 33 respectively of second portion 32. In the flat form of protector 10, the crush slit scores 38, 40 and 42 respectively form a "T" with crush slit scores 40 and 42 being co-linear and perpendicular to crush slit score 38.

Figure 5:
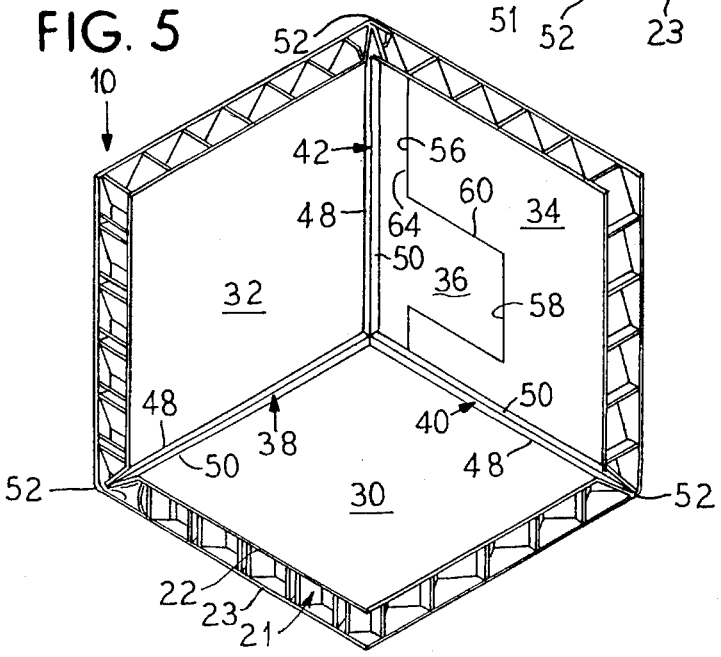
FIG. 5 is a perspective view of the corner protector blank of FIG. 2 in its folded position.

Referring to FIG. 4, the surfaces 48 and 50 of crush slit score 38 are preferably inclined at a bevel angle B in the range between 90 to 110 degrees to provide a spring biasing action between the surfaces 48 and 50 and thus the first and second portions 30 and 32 when the portions 30 and 32 are folded as shown FIG. 5. The spring biasing action between portions 30 and 32 is maximized by selecting an angle B in the lower end of the range. The spring biasing action between portions 30 and 32 is further enhanced where the width of slit 44 is equal to or less than about ¼ inches (6 mm.) since a decrease in the width of slit 44 corresponds to a decrease in the distance between surfaces 48 and 50.

Referring to FIG. 3, the surfaces 48 and 50 of crush slit score 40 are preferably inclined at a bevel angle C in the range between 110 to 130 degrees. Although not shown, the surfaces 48 and 50 of crush slit score 42 are also preferably inclined at an angle equal to the angle at which crush slit score 40 is inclined. Since bevel angle C is larger than bevel angle B, the spring biasing action between portions 32 and 36 and portions 30 and 34 is less than the spring biasing action between portions 30 and 32. The design and operation of crush slit scores for honeycomb panels is discussed in copending application Ser. No. 08/012,148 entitled Method and Apparatus for manufacturing Articles Employing Folded Honeycomb Panels filed Jan. 28, 1993.

Referring to FIG. 2, each of the first and second portions 30 and 32 respectively is a generally square member. The third portion 34 is a generally rectangular member including first and second adjacent and perpendicular sides or edges 54 and 56 respectively. The first side 54 is parallel to and foldably connected to the crush slit score 40. The second side 56 is parallel to and offset from the crush slit score 38. A notch 58, which is cut out of the second side 56, extends inwardly into portion 34. In the flat form of protector 10, the notch 58 is disposed perpendicular to the crush slit score 38 and parallel to the crush slit scores 40 and 42.

The fourth portion 36 is also a generally rectangular member including a finger 60 and first and second parallel sides or edges 62 and 64 respectively. The first side 62 is parallel to and foldably connected to the crush slit score 42. The finger 60 extends outwardly from the second edge 64. In the flat form of protector 10, the finger 60 is disposed perpendicular to the crush slit scores 40 and 42 and parallel to the crush slit score 38.

The protector 10 is shown in FIG. 5 in its folded and assembled position. Preferably, the protector 10 is assembled by rotating the second portion 32 about the fold-line 52 in the direction of first portion 30 until the surfaces 48 and 50 of crush slit score 38 abut each other. Then, third portion 34 is rotated about fold-line 52 in the direction of the folded second portion 32 until the surfaces 48 and 50 of crush slit score 40 abut each other. Thereafter, fourth portion 36 is connected to third portion 34 by rotating fourth portion 36 about the fold-line 52 in the direction of folded third portion 34 until the surfaces 48 and 50 of the crush slit score 42 abut each other and finger 60 on fourth portion 36 is engaged within the notch 58 in third portion 34. According to the present invention, the use of a finger 60 cooperating with a notch 58 dispenses with the need to tape, glue, or staple the third and fourth portions together during the folding operation.

Thus, in its folded position, the portions 30, 32 and 34 and the crush slit scores 38, 40 and 42 of protector 10 are disposed generally perpendicular to each other, the third and fourth portions 34 and 36 respectively are co-planar, the finger 60 is fitted within the notch 58 and the second edge 64 of fourth portion 36 abuts the second edge 56 of third portion 34. Further, third and fourth co-planar portions 34 and 36 respectively define a square member identical in size to the first and second square portions 30 and 32 respectively. In the folded position, the finger 60 and notch 58 are both positioned parallel to the crush slit score 40 and perpendicular to the crush slit score 42.

According to the present invention, the spring biasing action between first and second portions 30 and 32 created by the bevel angle B and the width of the slit 44 of crush slit score 38 causes the finger 60 to lock within the notch 58 thereby assuring that the protector 10 will not become unfolded at any point during the packing operation.

Figure 6:
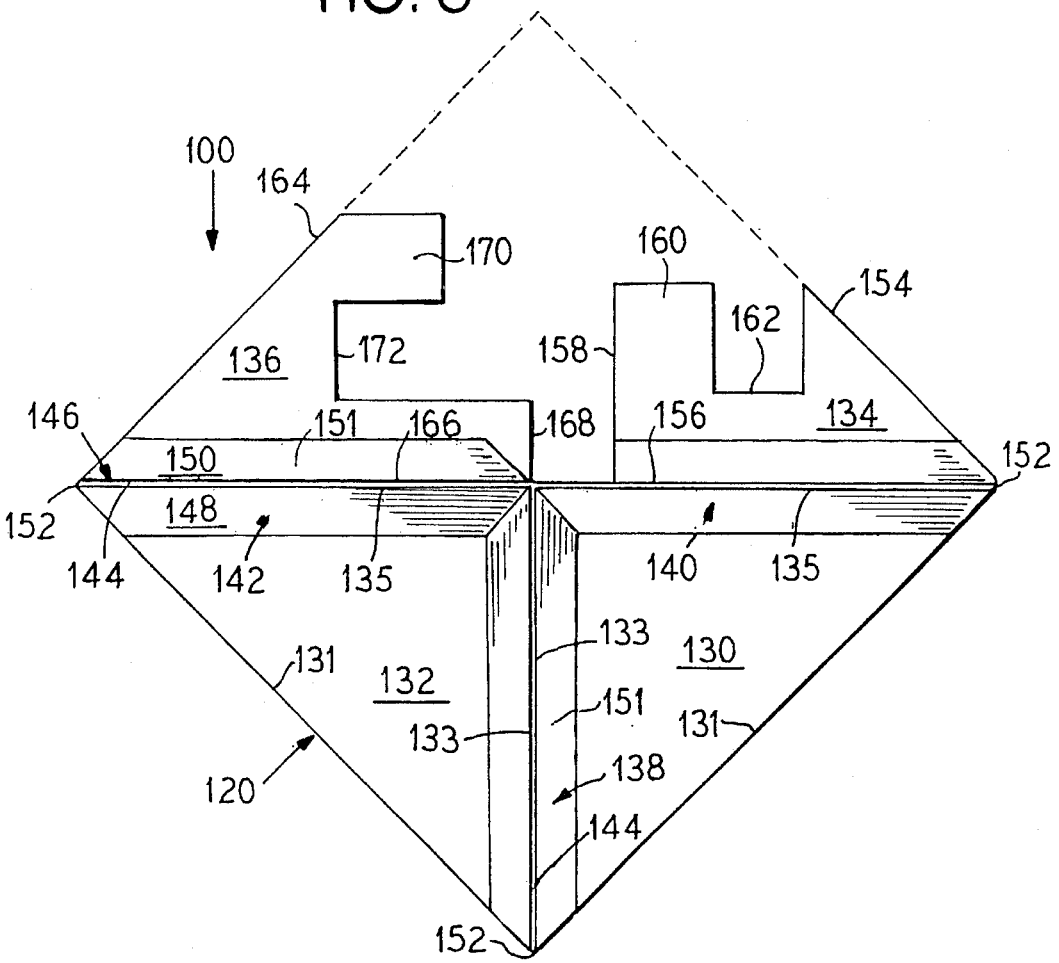
FIG. 6 is a plan view of a blank for forming a second embodiment of a corner protector according to the present invention.
Figure 7:
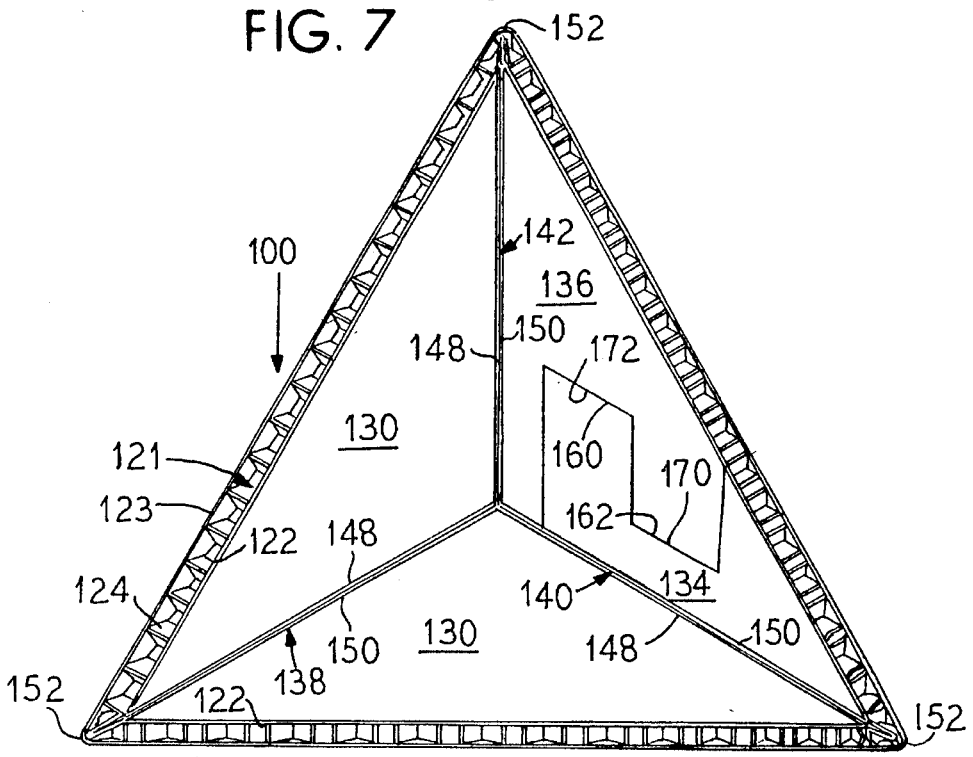
FIG. 7 is a perspective view of the corner protector blank of FIG. 6 in its folded position.

An alternate embodiment of a corner protector according to the present invention, generally designated 100, is depicted in FIGS. 1, 6 and 7.

Referring to FIGS. 6 and 7, the corner protector 100 comprises a panel 120 including a honeycomb core 121 sandwiched between a first face sheet 122 and a second face sheet 123. The core 121 is comprised of a plurality of honeycomb cells 124 which are disposed generally perpendicular to the face sheets 122 and 123. The core 121 of protector 100 differs from the core 21 of protector 10 in that core 121 has a width of about ½ inch (13 mm.) while core 21 has a width of about ¾ inches (19 mm.). According to the present invention, the cells may be made of any desired width. As with panel 20, panel 120 is likewise made from a honeycomb square blank, shown in phantom, measuring about 9 by 9 inches.

Referring to FIG. 6, the panel 120 includes a first portion 130, a second portion 132, a third portion 134 and a fourth portion 136. Each of the first and second portions 130 and 132 respectively is in the shape of a right isosceles triangle having sides or edges 131, 133 and 135, the side 131 defining the hypotenuse of the triangles and the sides 133 and 135 defining the two converging and adjacent sides of the triangles.

The first portion 130 is connected to the second portion 132 by a central crush slit score 138. The third portion 134 is connected to the first portion 130 by a central crush slit score 140. The fourth portion 136 is connected to the second portion 132 by a central crush slit score 142. In the flat form of protector 100, and as in protector 10, the crush slit scores 138, 140 and 142 form a "T" with crush slit scores 140 and 142 being co-linear and perpendicular to the crush slit score 138. Further, the crush slit scores 138 and 140 form the two converging or adjacent sides or edges 133 and 135 respectively of first portion 130 while the crush slit scores 138 and 142 form the two converging or adjacent sides or edges 133 and 135 respectively of second portion 132.

Each of the crush slit scores 138, 140 and 142 includes a longitudinally extending slit 144 which is cut through the first face sheet 122 and opposing inclined surfaces 148 and 150. The intact second face sheet 123 acts as a hinge or fold-line 152 about which the portions 130, 132, 134 and 136 rotate when the panel 120 is folded.

Crush slit scores 138, 140 and 142 are inclined at the same bevel angles B and C as crush slit scores 38, 40 and 42 of protector 10, respectively. Further, and referring to FIG. 6, the surfaces of crush slit scores 138, 140 and 142 may also include adhesive means 151 identical to adhesive means 51 on surfaces 48 and 50 of crush slit scores 38, 40 and 42 of protector 10.

The third portion 134 is a portion of a right isosceles triangle including a segment of a hypotenuse 154 and segments of first and second sides or edges 156 and 158 respectively. The first side 156 is foldably connected to and parallel to the crush slit score 140. The second side 158 is parallel to and offset from the crush slit score 138. A finger 160 and an adjacent and parallel notch 162 are cut out of the hypotenuse 154. In the flat form of protector 100, the finger 160 and notch 162 are perpendicular to the crush slit scores 140 and 142 and parallel to the crush slit score 138.

The fourth portion 136 also comprises a portion of a right isosceles triangle including a segment of a hypotenuse 164 and segments of first and second sides or edges 166 and 168 respectively. The first side 166 of fourth portion 136 is foldably connected to and parallel to the crush slit score 142. A finger 170 and an adjacent and parallel notch 172 are cut out of the second side 168. In the flat form of protector 100, the finger 170 and notch 172 are disposed parallel to the crush slit scores 140 and 142 and perpendicular to the crush slit score 138.

Preferably, and referring to FIG. 7, the protector 100 is assembled by first rotating the second portion 132 about the hinge 152 in the direction of first portion 130 until the surfaces 148 and 150 of crush slit score 138 abut each other. Then, third portion 134 is rotated about hinge 152 in the direction of the folded second portion 132 until the surfaces 148 and 150 of crush slit score 140 abut each other. Thereafter, fourth portion 136 is connected to third portion 134 by rotating the fourth portion 136 about the hinge 152 in the direction of folded third portion 134 until the surfaces 148 and 150 of crush slit score 142 abut each other and the finger 160 on third portion 134 is fitted into the notch 172 in fourth portion 136 and the finger 170 on fourth portion 136 is fitted into the notch 162 in third portion 134. Again, the use of fingers 160 and 170 and notches 162 and 172 dispenses with the need for taping, gluing, or stapling the third and fourth portions together during the folding operation.

In its folded position, protector 100 is in the form of a pyramid. More particularly, first, second and third portions 130, 132 and 134 respectively and crush slit scores 130, 140 and 142 are disposed generally perpendicular to each other, the third and fourth portions 134 and 136 respectively are co-planar and form a right isosceles triangle which is identical in size and perpendicular to the right isosceles triangles comprising the first and second portions 130 and 132.

In the folded position of protector 100, and according to the present invention, the spring biasing action between the first and second portions 130 and 132 created by bevel angle B and the width of slit 144 of crush slit score 138 causes the fingers 160 and 170 to lock within the notches 162 and 172 respectively thereby assuring that the protector 100 will not become unfolded during the packing operation. As with the corner protector 10, the spring biasing action between portions 130 and 132 may be enhanced by selecting an angle B in the lower end of the range and by reducing the width of slit 144. Further, in the folded position, the fingers 160 and 170 and the notches 162 and 172 of third and fourth portions 134 and 136 respectively are disposed parallel to the crush slit score 142 and perpendicular to the crush slit scores 138 and 140.

Figure 8:
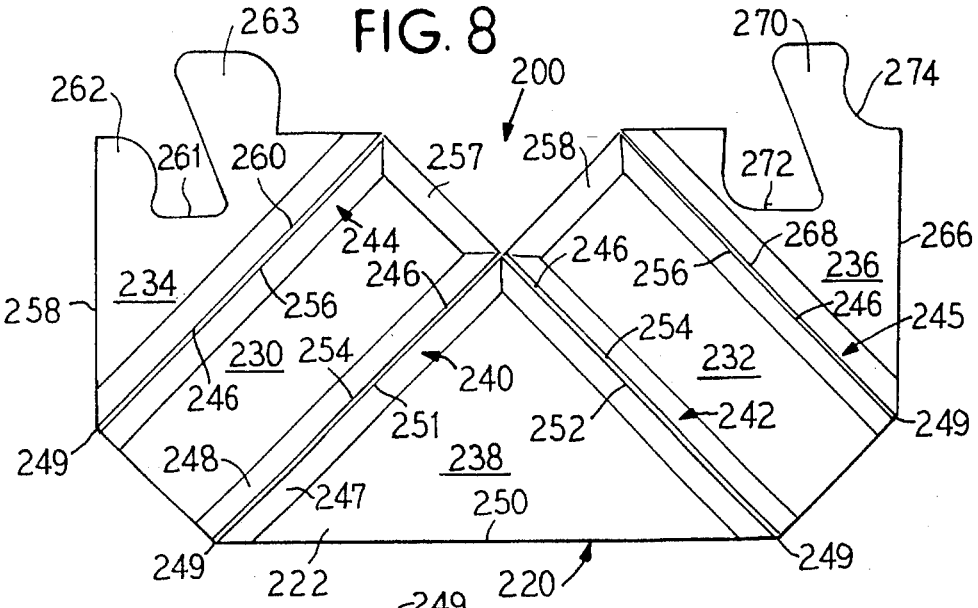
FIG. 8 is a plan view of a blank for forming a third embodiment of a corner protector according to the present invention.
Figure 9:
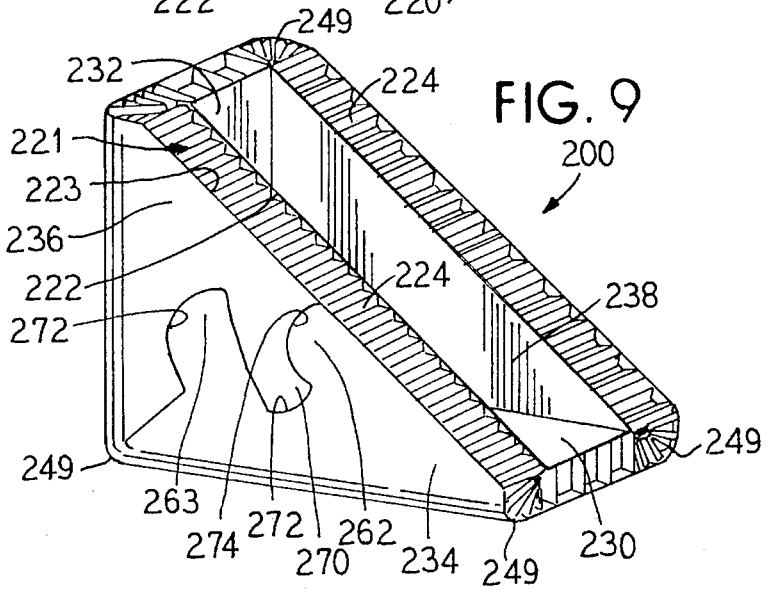
FIG. 9 is a perspective view of the corner protector blank of FIG. 8 in its folded position.

Yet another embodiment of a corner protector according to the present invention, generally designated 200, is depicted in FIGS. 8 and 9. Corner protector 200 can be used to protect the corners or edges of flat objects such as doors and desk tops.

Referring to FIGS. 8 and 9, the corner protector 200 comprises a panel 220 including a honeycomb core 221 sandwiched between a first face sheet 222 and second face sheet 223. The core 221 is comprised of a plurality of honeycomb cells 224 which are disposed generally perpendicular to the face sheets 222 and 223.

The panel 220 includes a first portion 230, a second portion 232, a third portion 234, a fourth portion 236 and a fifth portion 238. The first portion 230 is connected to the fifth portion 238 by a crush slit score 240. The second portion 232 is connected to the fifth portion 238 by a crush slit score 242. The third portion 234 is connected to the first portion 230 by a crush slit score 244. The fourth portion 236 is connected to the second portion 232 by a crush slit score 245. In its blank and unfolded form, crush slit scores 240 and 244 are disposed parallel to each other. Further, crush slit scores 242 and 245 are disposed parallel to each other but perpendicular to crush slit scores 240 and 244.

Each of the crush slit scores 240, 242, 244 and 245 includes a longitudinally extending slit 246 which is cut through the first face sheet 222 and opposed inclined surfaces 247 and 248. The intact second face sheet 223 acts as a hinge or fold-line 249 about which the portions 230, 232, 234 and 236 rotate when the panel 220 is folded.

As with crush slit cores 38 and 138 of corner protectors 10 and 100 respectively, the crush slit scores 240 and 242 of protector 200 are inclined at a bevel angle B ranging from between approximately 90 to 110 degrees to provide a spring biasing action between portions 230 and 238 and between portions 232 and 238 when the portions are folded. The spring biasing action between portions 230, 232 and 238 is likewise maximized by selecting a bevel angle B in the lower end of the range and by reducing the width of slit 246. As with crush slit scores 40 and 42 of corner protector 10 and crush slit scores 140 and 142 of corner protector 100, crush slit scores 244 and 245 of corner protector 200 are inclined at a bevel angle C ranging between approximately 100 to 130 degrees.

The fifth portion 238 is preferably the shape of a right isosceles triangle having sides or edges 250, 251 and 252, the side 250 defining the hypotenuse of the triangle and the sides 251 and 252 defining the two converging and adjacent sides of the triangle.

Each of the first and second portions 230 and 232 is preferably in the shape of a rectangle having opposite sides 254 and 256 equal in length to the sides 251 and 252 of fifth portion 238. The side 254 of first portion 230 is parallel to the side 251 of fifth portion 238 and is foldably connected thereto via crush slit score 240. The side 254 of second portion 232 is parallel to the side 252 of fifth portion 238 and is foldably connected thereto via crush slit score 242. The first and second portions 230 and 232 respectively include edges 257 and 258 respectively which are preferably beveled to allow better cooperation between the portions 230 and 232 when the protector 200 is in its folded position.

The third portion 234 is a portion of a triangle including a segment of a hypotenuse 259 and a side 260. The side 260 of third portion 234 is parallel to the side 256 of first portion 230 and is foldably connected thereto via crush slit score 244. The third portion 234 further includes a notch 261 disposed between first and second fingers 262 and 263 respectively. The finger 262 is smaller than the finger 263. The notch 261 and fingers 262 and 263 are angularly disposed with respect to side 260 of third portion 234.

The fourth portion 236 is also a portion of a triangle including a segment of a hypotenuse 266 and a side 268. The side 268 of fourth portion 236 is parallel to the side 256 of second portion 232 and is foldably connected thereto via crush slit score 245. The fourth portion 234 further includes a finger 270 disposed between first and second notches 272 and 274 respectively. The notch 272 is larger then the notch 274.

Once the four crush slit scores 240, 242, 244 and 245 are folded, the corner protector 200 of FIG. 9 is formed. The corner protector 200 is suitable for protecting items such as doors for shipment. The size of the corner protector 200 may be varied to suit particular applications by varying the dimensions of portions 230, 232, 234 and 236.

Preferably, the corner protector 200 is formed by rotating the first portion 230 about the hinge 249 in the direction of fifth portion 238 until the surfaces 247 and 248 of crush slit score 240 abut each other. Then, second portion 232 is rotated about the hinge 249 in the direction of fifth portion 248 until the surfaces 247 and 248 of crush slit score 242 abut each other. Then, fourth portion 236 is rotated about the hinge 249 in the direction of folded second portion 232 until the surfaces 247 and 248 of crush slit score 245 abut each other. Finally, the third portion 234 is rotated about the hinge 249 in the direction of folded fourth portion 236 until the surfaces 247 and 248 of crush slit score 244 abut each other and the fingers 262 and 263 on third portion 234 are fitted into the notches 274 and 272 respectively in fourth portion 236 and the finger 270 on fourth portion 236 is fitted into the notch 261 in third portion 234.

Thus, in its folded position, the first, second and fifth portions 230, 232 and 238 respectively, are disposed generally perpendicular to each other. Crush slit scores 240 and 244 are disposed parallel to each other. Crush slit scores 242 and 245 are disposed parallel to each other but perpendicular to crush slit scores 240 and 244. The third and fourth portions 234 and 236 respectively, are co-planar and preferably define a right isosceles triangle parallel to and identical in size to the triangle comprising the fifth portion 238.

In the folded position of corner protector 200, the spring biasing action between the first and fifth portions 230 and 238 respectively which is caused by the bevel angle of crush slit score 240 and the width of slit 246 therein and the spring biasing action between the second and fifth portions 232 and 238 respectively which is caused by the bevel angle of crush slit score 242 and the width of the slit 246 therein causes the fingers 262 and 263 on the third portion 234 to lock within the notches 274 and 272 respectively in the fourth portion 236 and the finger 270 on fourth portion 236 to lock within the notch 261 in third portion 234 thereby assuring that the corner protector 200 will not become unfolded during the packing operation.

It is thus observed that the corner protectors 10, 100 and 200 with the interlocking portions constructed in accordance with the present invention possess the important advantage of remaining folded throughout the packing operation without any taping, gluing or stapling during the folding operation. The result is the elimination of the additional labor which is presently required when protectors must be taped, glued or stapled during the folding operation and subsequently refolded during packing when the tape, glue, or staples fail. The result is a less expensive, more efficient packing operation.

Figure 10:
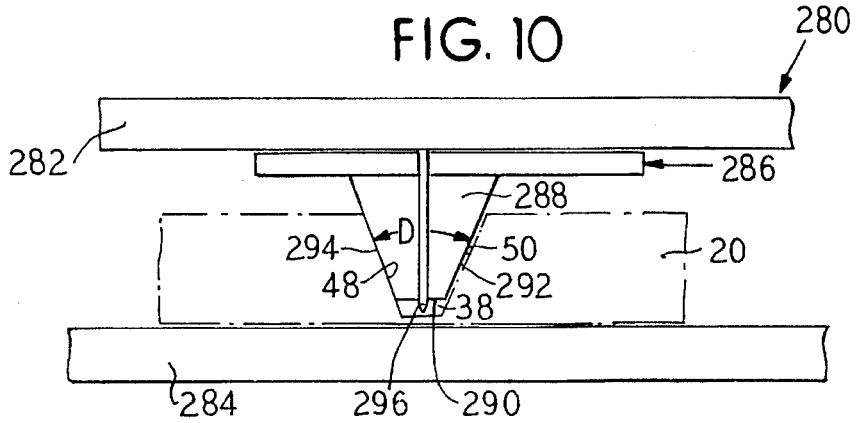
FIG. 10 is a fragmentary, vertical cross-section of a wedge and knife combination for forming the crush slit scores of the corner protectors according to the present invention.

According to the invention, the crush slit scores in each of the corner protectors 10, 100 and 200 are preferably formed in one step with a wedge and knife combination. FIG. 10 depicts a portion of a die press 280 including a top plate 282 and a bottom plate 284. A die-cutting tool 286 is mounted to the bottom of top plate 282. The honeycomb panel 20 to be cut is positioned between plates 282 and 284. The tool 286 includes a wedge 288 having a distal flat face 290 and opposed surfaces 292 and 294 diverging rearwardly from the flat face 296 at an angle D in the range between approximately 90 to 110 degrees or 110 to 130 degrees, i.e., in the range corresponding to either crush slit score angle B or C respectively (FIGS. 3 and 4). A knife 296 projects outwardly from the flat face 290.

FIG. 10 depicts the forming of crush slit score 38 in panel 20 (FIGS. 2 and 4). As the plate 282 is brought down upon the panel 20, the knife 296 cuts the slit 44 (FIG. 4) through the first face sheet 22 and the core 21. The wedge 288 then follows the knife 296 into the slit 44 to form the inclined surfaces 48 and 50 of the crush slit score 38. The flat face 290 crushes the core 21 and pushes the surfaces 48 and 50 away from each other. The surfaces 292 and 294 then position the surfaces 48 and 50 of crush slit score 38 at the preselected angle to result in angle B or C in the panel. According to the invention, the width of slit 44 and thus the distance between surfaces 48 and 50 of crush slit score 38 is dependent upon the width of the flat face 290 on wedge 288. Generally, the greater the width of flat face 290, the greater the width of slit 44 and thus the distance between surfaces 48 and 50. As explained earlier, maximum spring biasing action is achieved where the width of slit 44 in crush slit score 38 is equal to or less than ¼ inches (6 mm.). Thus, in applications where maximum spring biasing action is desired, a wedge 288 with a flat face 290 having a width equal to or less than ¼ inches (6 mm.) is used.

Although FIG. 10 depicts only the wedge 288 for forming the crush slit score 38, it is understood that the tool 286 likewise includes additional wedges mounted thereon in a preselected pattern for forming the crush slit scores 40 and 42 of panel 20. The wedges for forming crush slit scores 40 and 42 differ from the wedge 288 in that their surfaces are inclined to create angle C in the panel rather than angle B. Further, and although not shown in FIG. 10, it is understood that the tool 286, in addition to wedges, includes a plurality of knives mounted thereon in a preselected pattern for cutting each of the panels 20, 120 and 220 into their desired shapes.

The foregoing is illustrative of the principles of the invention. Further, since numerous modifications and changes will readily occur to those skilled in the art, it is not desired to limit the invention to the exact construction and operation shown and described. Accordingly, all suitable modifications and equivalents may be resorted to while still falling within the scope of the invention.

What is claimed is:

1. A foldable protector for the corner or edge of an object comprising a panel including a honeycomb core, the panel having first, second, third and fourth foldable portions, the first portion being foldably connected to the second portion by a crush slit score, the third portion being foldably connected to the first portion by a crush slit score and positioned perpendicular to the first and second portions in the folded position, the fourth portion being foldably connected to the second portion by a crush slit score, the fourth portion being co-planar with the third portion and perpendicular to the first and second portions in the folded position, one of the third and fourth portions including a notch and the other of the third and fourth portions including a finger, the finger fitting within the notch to connect the third and fourth portions in the folded position, at least one of the crush slit scores having a bevel angle providing a spring biasing action to cause the locking of the finger on one of the third and fourth portions into the notch in the other of the third and fourth portions in the folded position.

2. The protector of claim 1, wherein each of the crush slit scores has a bevel angle, the crush slit score foldably connecting the first and second portions having a bevel angle in a range providing a spring biasing action between the first and second portions to cause the locking of the finger in one of the third and fourth portions into the notch in the other of the third and fourth portions in the folded position.

3. The protector of claim 2, wherein the crush slit scores foldably connecting the first and third portions and the second and fourth portions have bevel angles greater than the bevel angle of the crush slit score foldably connecting the first and second portions.

4. The protector of claim 3, wherein the crush slit score foldably connecting the first and second portions has a bevel angle in the range between approximately 90 to 110 degrees and the crush slit scores foldably connecting the first and third portions and the second and fourth portions have bevel angles in a range between approximately 100 to 130 degrees.

5. A foldable protector for the corner or edge of an object comprising a panel including a honeycomb core, the panel having first, second, third, fourth and fifth foldable portions, the first portion cooperating with the second portion in the folded position, the third portion being foldably connected to the first portion by a crush slit score and positioned perpendicular to the first and second portions in the folded position, the fourth portion being foldably connected to the second portion by a crush slit score, the fourth portion being co-planar with the third portion and perpendicular to the first and second portions in the folded position, the fifth portion being foldably connected to the first and second portions by respective crush slit scores, the fifth portion being perpendicular to the first and second portions in the folded position, one of the third and fourth portions including a notch and the other of the third and fourth portions including a finger, the finger fitting within the notch to connect the third and fourth portions in the folded position, each of the crush slit scores having a bevel angle, the respective crush slit scores foldably connecting the first and second portions to the fifth portion having a bevel angle in a range providing a spring biasing action between the first and second portions and the fifth portion to cause the locking of the finger on one of the third and fourth portions in the notch in the other of the third and fourth portions in the folded position.

6. The protector of claim 5, wherein the crush slit scores foldably connecting the first and third portions and the second and fourth portions have bevel angles in a range greater than the angle of the bevel angle of the crush slit scores foldably connecting the first and second portions to the fifth portion.

7. The protector of claim 6, wherein the crush slit scores foldably connecting the first and second portions to the fifth portion have bevel angles in the range between approximately 90 to 110 degrees and the crush slit scores foldably connecting the first and third portions and the second and fourth portions have bevel angles in the range between approximately 110 to 130 degrees.

8. A corner protector having a flat position and a folded position, the corner protector comprising a panel including first, second, third and fourth portions, the second portion being connected by a crush score to the first portion and positioned perpendicular to the first portion in the folded position, the crush score connecting the first and second portions having a bevel angle providing a spring biasing action between the first and second portions in the folded position, the third portion being connected to the first portion by a crush score and positioned perpendicular to the first and second portions in the folded position, the fourth portion being connected by a crush score to the second portion, the fourth portion being co-planar with the third portion and perpendicular to the first and second portions in the folded position, the crush score connecting the first and third portions and the second and fourth portions having a bevel angle greater than the bevel angle of the crush score connecting the first and second portions, and a coupling associated with the third and fourth portions for connecting the third and fourth portions together in the folded position such that the spring biasing action between the first and second portions causes the locking of the coupling associated with the third and fourth portions in the folded position.

9. The corner protector of claim 8, wherein the bevel angle of the crush slit score foldably connecting the first and second portions is in a range between approximately 90 to 110 degrees and the bevel angle of the crush slit score foldably connecting the first and third portions and the second and fourth portions is in a range between approximately 110 to 130 degrees.

10. A corner protector having a flat position and a folded position, the corner protector comprising a panel including first, second, third and fourth portions, the second portion being foldably connected by a crush slit score to the first portion and positioned perpendicular to the first portion in the folded position, the crush slit score foldably connecting the first and second portions having a bevel angle providing a spring biasing action between the first and second portions in the folded position, the third portion being foldably connected to the first portion by a crush slit score and positioned perpendicular to the first and second portions in the folded position, the fourth portion being foldably connected by a crush slit score to the second portion, the fourth portion being co-planar with the third portion and perpendicular to the first and second portions in the folded position, the crush slit score foldably connecting the first and third portions and the second and fourth portions having a bevel angle greater than the bevel angle of the crush slit score foldably connecting the first and second portions, and a coupling for connecting the third and fourth portions together in the folded position, the coupling comprising a notch in the third portion and a finger on the fourth portion, the finger fitting within the notch to connect the third and fourth portions together in the folded position such that the spring biasing action between the first and second portions causes the finger to lock in the notch.

11. The corner protector of claim 10, wherein the notch extends generally parallel to the crush slit score foldably connecting the first and third portions and the finger extends generally perpendicular to the crush slit scores foldably connecting the first and third portions and the second and fourth portions in the flat position, the finger extending generally parallel to the crush slit score foldably connecting the first and second portions and generally perpendicular to the crush slit score foldably connecting the second and fourth portions in the folded position.

12. The corner protector of claim 10, wherein the coupling comprises a notch in the third portion and a finger on the fourth portion, the third portion including first and second sides, the first side of the third portion being connected to the crush slit score foldably connecting the first and third portions, the second side being parallel to the crush slit score foldably connecting the first and third portions and offset therefrom, the notch being cut out of the second side and extending generally parallel to the crush slit score foldably connecting the first and third portions, the fourth portion including the finger and first and second sides, the first side of the fourth portion being connected to the crush slit score foldably connecting the second and fourth portions, the finger extending outwardly from the second side of the fourth portion which is parallel to the first side in the flat position, the finger fitting within the notch and the second side of the fourth portion abutting the second side of the third portion in the folded position to co-planarly connect the third and fourth portions, the spring biasing action between the first and second portions causing the finger to lock in the notch.

13. A corner protector having a flat position and a folded position, the corner protector comprising a panel including first, second, third and fourth portions, the second portion being foldably connected by a crush slit score to the first portion and positioned perpendicular to the first portion in the folded position, the crush slit score foldably connecting the first and second portions having a bevel angle providing a spring biasing action between the first and second portions in the folded position, the third portion being foldably connected to the first portion by a crush slit score and positioned perpendicular to the first and second portions in the folded portion, the fourth portion being foldably connected by a crush slit score to the second portion, the fourth portion being co-planar with the third portion and perpendicular to the first and second portions in the folded portion, the crush slit score foldably connecting the first and third portions and the second and fourth portions having a bevel angle greater than the bevel angle of the crush slit score foldably connecting the first and second portions, and a coupling for connecting the first and fourth portions together in the folded position comprising a finger on and a notch in each of the third and fourth portions, the notch being adjacent to and generally parallel to the finger on each of the third and fourth portions, the finger on the third portion fitting into the notch in the fourth portion and the finger on the fourth portion fitting into the notch in the third portion in the folded position such that the spring biasing action causes each of the fingers to lock into each of the notches respectively.

14. The corner protector of claim 13, wherein the third portion comprises a portion of a triangle with a segment of a hypotenuse and segments of first and second sides, the first side being connected to the crush slit score foldably connecting the first and third portions, the finger on and the notch in the third portion being cut out of the second side and the hypotenuse, the finger being adjacent to and parallel to the notch, the finger on and the notch in the third portion being perpendicular to the crush slit score foldably connecting the first and third portions in the flat position, the fourth portion comprising a portion of a triangle with a segment of a hypotenuse and segments of first and second sides, the first side of the fourth portion being connected to the crush slit score foldably connecting the second and fourth portions, the finger on and the notch in the fourth portion being cut out of the second side and the hypotenuse, the finger being adjacent to and parallel to the notch, the finger on and the notch in the fourth portion being parallel to the crush slit score foldably connecting the second and fourth portions in the flat position.

15. A blank for forming a protector for the corner or edge of an object comprising a panel including foldable first, second, third and fourth portions, the second portion being foldably connected along a central fold-line to the first portion, the third portion being foldably connected along a central fold-line to the first portion, the third portion including a notch and first and second sides, the first side of the third portion being adjacent to and parallel to the fold-line foldably connecting the first and third portions, the second side being parallel to the fold-line foldably connecting the first and second portions and offset therefrom, the notch being cut out of the second side, the fourth portion being foldably connected along a central fold-line to the second portion, the fold-line foldably connecting the second and fourth portions being co-linear with the fold-line foldably connecting the first and third portions and perpendicular to the fold-line foldably connecting the first and second portions, the fourth portion including a finger and first and second sides, the first side of the fourth portion being adjacent and parallel to the fold-line foldably connecting the second and fourth portions, the finger extending from the second side of the fourth portion, such that when the panel is folded, the first, second and third portions are generally perpendicular to each other, the third and fourth portions are co-planar, the finger fits in the notch and the second side of the fourth portion abuts the second side of the third portion to connect the third and fourth portions.

16. The blank of claim 15, wherein each of the fold-lines comprises a crush slit score having a bevel angle, the crush slit score foldably connecting the first and second portions having a bevel angle providing a spring biasing action to lock the finger in the notch when the panel is folded.

17. The blank of claim 16, wherein the crush slit scores foldably connecting the first and third portions and the second and fourth portions have a bevel angle greater than the bevel angle of the crush slit score foldably connecting the first and second portions.

18. The blank of claim 17, wherein the crush slit score foldably connecting the first and second portions has a bevel angle in a range between approximately 90 to 110 degrees and the crush slit scores foldably connecting the first and third portions and the second and fourth portions have a bevel angle in a range between approximately 110 to 130 degrees.

19. A blank for forming a single layered protector for the corner or edge of an object, the blank comprising respective first, second, third and fourth single layered portions, the second portion being foldably connected along a common fold-line to the first portion, the third portion being connected along a common fold-line to the first portion, the third portion being connected along a common fold-line to the first portion, the third portion including an outside edge having a finger and a notch positioned therein in co-planar, side-by-side relationship, the respective fold-lines connecting the first and second portions and the first and third portions being perpendicular to each other, the fourth portion being connected along a common fold-line to the second portion, the fourth portion including an outside edge having a finger and a notch positioned therein in co-planar, side-by-side relationship, the fold-line connecting the second and fourth portions being co-linear with the fold-line connecting the first and third portions and also perpendicular to the fold-line connecting the first and second portions, the interrelationship between the fold lines and the outside edges of the third and fourth portions being such that, when the blank is folded along the respective fold lines, the single layered protector is formed wherein the first, second, and third portions are generally perpendicular to each other, and the third and fourth portions are co-planar and matingly interengaged with each other along the respective outside edges, and the finger on and the notch in the third and fourth portions respectively are co-planar and matingly interdigitated with each other whereby the finger on the third portion fits into the notch in the fourth portion and the finger on the fourth portion fits into the notch in the third portion.

20. The corner protector of claim 19, wherein the third portion is a portion of a triangle including a segment of a hypotenuse and segments of first and second sides, the first side being adjacent and parallel to the fold-line foldably connecting the first and third portions, the finger on and the notch in the third portion being cut out of the second side and the hypotenuse.

21. The corner protector of claim 19, wherein the fourth portion is a portion of a triangle including a segment of a hypotenuse and segments of first and second sides, the first side being adjacent and parallel to the fold-line foldably connecting the second and fourth portions and the finger on and the notch in the fourth portion being cut out of the second side and of the hypotenuse.

22. A blank for forming a protector for the corner or edge of an object comprising a panel including first, second, third and fourth foldable portions, the second portion being foldably connected along a central fold-line to the first portion, the third portion being foldably connected along a central fold-line to the first portion, the third portion including a finger and a notch adjacent to and generally parallel to the finger, the fold-lines foldably connecting the first and second portions and the first and third portions being perpendicular to each other, the fourth portion being foldably connected along a central fold-line to the second portion, the fourth portion including a finger and a notch adjacent to and generally parallel to the finger, the fold-line foldably connecting the second and fourth portions being co-linear with the fold-line foldably connecting the first and third portions and perpendicular to the fold-line foldably connecting the first and second portions, the finger on and the notch in the third portion extending generally perpendicular to the fold-line foldably connecting the first and third portions and the finger on and the notch in the fourth portion extending generally parallel to the fold-line foldably connecting the second and fourth portions, such that when the panel is folded, the first, second, and third portions are generally perpendicular to each other, the third and fourth portions are co-planar and the finger on the third portion fits in the notch in the fourth portion and the finger on the fourth portion fits in the notch in the third portion.

23. A blank for forming a protector for the corner or edge of an object comprising a panel including first, second, third and fourth foldable portions, the second portion being foldably connected along a central fold-line to the first portion, the third portion being foldably connected along a central fold-line to the first portion, the third portion including a finger and a notch adjacent to and generally parallel to the finger, the fold-lines foldably connecting the first and second portions and the first and third portions being perpendicular to each other, the fourth portion being foldably connected along a central fold-line to the second portion, the fourth portion including a finger and a notch adjacent to and generally parallel to the finger, the fold-line foldably connecting the second and fourth portions being co-linear with the fold-line foldably connecting the first and third portions and perpendicular to the fold-line foldably connecting the first and second portions, each of the fold-lines comprising a crush slit score having a bevel angle, the crush slit score foldably connecting the first and second portions having a bevel angle providing a spring biasing action such that when the panel is folded, the first, second, and third portions are generally perpendicular to each other, the third and fourth portions are co-planar and the finger on the third portion locks in the notch in the fourth portion and the finger on the fourth portion locks in the notch in the third portion.

24. The blank of claim 23, wherein the crush slit scores foldably connecting the first and third portions and the second and fourth portions have a bevel angle greater than the bevel angle of the crush slit score foldably connecting the first and second portions.

25. The blank of claim 24, wherein the crush slit score foldably connecting the first and second portions has a bevel angle in a range between approximately 90–110 degrees add the crush slit scores foldably connecting the first and third portions and the second and fourth portions have a bevel angle in a range between approximately 110–130 degrees.

26. A blank for forming a protector for the corner or edge of an object comprising first, second, third, fourth and fifth portions, the fifth portion including first and second converging sides, each of the first and second portions including first and second sides, the first side of the first portion being connected to the first side of the fifth portion along a common fold-line and the first side of the second portion being connected to the second side of the fifth portion along a common fold-line, each of the third and fourth portions including a side, the side of the third portion being connected to the second side of the first portion along a common fold-line and the side of the fourth portion being connected to the second side of the second portion along a common fold-line, and a coupling associated with the third and fourth portions comprising a finger and a notch positioned respectively in an outside edge of each of the third and fourth portions in co-planar, side-by-side relationship such that when the blank is folded, the first, second and fifth portions are perpendicular to each other, the third and fourth portions are co-planar and matingly interengaged with each other along the respective outside edges and perpendicular to the first and second portions, and the finger on and the notch in the third and fourth portions respectively are co-planar and matingly interdigitated with each other whereby the finger on the third portion fits into the notch in the fourth portion and the finger on the fourth portion fits into the notch in the third portion to connect the third and fourth portions together.

27. A blank for forming a protector for the corner or edge of an object comprising a panel including first, second, third, fourth and fifth portions, the fifth portion including foldable first and second converging sides, each of the first and second portions including first and second sides, the first side of the first portion being foldably connected to the first side of the fifth portion along a fold-line and the first side of the second portion being foldably connected to the second side of the fifth portion along a fold-line, each of the third and fourth portions including a side, the side of the third portion being foldably connected to the second side of the first portion along a fold-line and the side of the fourth portion being foldably connected to the second side of the second portion along a fold-line, one of the third and fourth portions including first and second fingers and a notch therebetween, the other of the third and fourth portions including first and second notches and a finger therebetween, such that when the panel is folded, the first, second and fifth portions are perpendicular to each other, the third and fourth portions are co-planar and perpendicular to the first and second portions, and the first and second fingers fit within the first and second notches respectively and the finger fits within the notch to couple the third and fourth portions together.

28. A blank for forming a protector for the corner or edge of an object comprising a panel including foldable first, second, third, fourth and fifth portions, the fifth portion including first and second converging sides, each of the first and second portions including first and second sides, the first side of the first portion being foldably connected to the first side of the fifth portion along a fold-line and the first side of the second portion being foldably connected to the second side of the fifth portion along a fold-line, each of the third and fourth portions including a side, the side of the third portion being foldably connected to the second side of the first portion along a fold-line and the side of the fourth portion being foldably connected to the second side of the second portion along a fold-line, each of the fold-lines comprising a crush slit score having a bevel angle, the respective crush slit scores foldably connecting the first and second portions to the fifth portion having a bevel angle providing a spring biasing action between the first and fifth portions and the third and fifth portions, and a coupling associated with the third and fourth portions such that when the panel is folded, the first, second and fifth portions are perpendicular to each other, the third and fourth portions are co-planar and perpendicular to the first and second portions, the coupling associated with the third and fourth portions connects the third and fourth portions together and the spring biasing action between the first and fifth portions and the third and fifth portions locks the third and fourth portions together.

29. The blank of claim 28, wherein the crush slit scores foldably connecting the first and third portions and the second and fourth portions have a bevel angle greater than the bevel angle foldably connecting the first and second portions to the fifth portion.

30. The blank of claim 29, wherein the crush slit scores foldably connecting the first and second portions to the fifth portion have a bevel angle in a range between approximately 90 to 110 degrees and the crush slit scores foldably connecting the first and third portions and the second and fourth portions have bevel angles in a range between approximately 110 to 130 degrees.

31. A foldable protector for the corner or edge of an object comprising a panel including first, second, third and fourth portions, the first portion being foldably connected to the second portion by a crush score, the third portion being connected to the first portion along a fold-line and positioned perpendicular to the first portion, the fourth portion being connected to the second portion along a fold-line, the fourth portion being co-planar with the third portion and perpendicular to the second portion, one of the third and fourth portions including a notch and the other of the third and fourth portions including a finger, the finger fitting within the notch to connect the third and fourth portions in the folded position, the crush score foldably connecting the first and second portions having a bevel angle providing a spring biasing action to cause the locking of the finger on one of the third and fourth portions into the notch in the other of the third and fourth portions in the folded position.

32. The protector of claim 31 wherein the first portion is foldably connected to the third portion and the second portion is foldably connected to the fourth portion, the third and fourth portions being positioned perpendicular to the first and second portions respectively in the folded position.

33. The protector of claim 31 wherein the first portion is connected to the second portion by a crush slit score.

34. The protector of claim 31 wherein the first portion is connected to the second portion by a crush slit score and the fold-line connecting the first and third portions and the second and fourth portions comprises a crush slit score.

35. The protector of claim 34 wherein the crush slit score connecting the first and third portions and the second and fourth portions has a bevel angle greater than the bevel angle of the crush slit score connecting the first and second portions.

36. The protector of claim 31 wherein the panel includes a honeycomb core.

37. A foldable protector for the corner or edge of an object comprising first, second, third and fourth portions, the first portion being foldably connected to the second portion by a crush score, the third portion being connected to the first portion along a fold-line and positioned substantially perpendicular to the first portion, the fourth portion being connected to the second portion along a fold-line, the fourth portion being substantially co-planar with the third portion and substantially perpendicular to the second portion, one of the third and fourth portions including a notch and the other of the third and fourth portions including a finger, the finger fitting within the notch to connect the third and fourth portions in the folded position, the crush score foldably connecting the first and second portions having a bevel angle providing a spring biasing action to cause the locking of the finger into the notch to maintain the first and second portions in the folded position.

38. The protector of claim 37 wherein the first portion is foldably connected to the third portion and the second portion is foldably connected to the fourth portion, the third and fourth portions being positioned substantially perpendicular to the first and second portions respectively in the folded position.

39. The protector of claim 37 wherein the first portion is connected to the second portion by a crush slit score.

40. The protector of claim 37 wherein the first portion is connected to the second portion by a crush slit score and the fold-line connecting the first and third portions and the second and fourth portions comprises a crush slit score.

41. The protector of claim 40 wherein the crush slit score connecting the first and third portions and the second and fourth portions has a bevel angle greater than the bevel angle of the crush slit score connecting the first and second portions.

42. The protector of claim 37 wherein each of the first, second, third and fourth portions includes a honeycomb core.

* * * * *